United States Patent [19]

Meier-Windhorst

[11] 3,954,394

[45] May 4, 1976

[54] METHOD FOR THE COMBINED PRECLEANING TEXTURE FORMATION AND STABILIZATION AND COLORING OF TEXTILE MATERIALS

[76] Inventor: Christian August Meier-Windhorst, Heidenkampsweg 66, 2 Hamburg 1, Germany

[22] Filed: Jan. 15, 1975

[21] Appl. No.: 541,294

Related U.S. Application Data

[63] Continuation-in-part of Ser. No. 272,596, July 17, 1972, abandoned.

[52] U.S. Cl. ..... 8/17; 8/21 B; 8/149; 8/151.2; 28/75 WT; 57/164

[51] Int. Cl.[2] ..... D06P 3/24; D06P 3/52; D06P 3/82; D06P 7/00

[58] Field of Search ..... 8/17, 151.2; 28/75 WT, 28/72.1; 57/164

[56] References Cited

UNITED STATES PATENTS

| | | | |
|---|---|---|---|
| 2,041,338 | 5/1936 | Harrison | 8/151.2 |
| 2,251,931 | 8/1941 | Gundelfinger | 8/151.2 |
| 2,504,183 | 4/1950 | Croft | 28/75 WT |
| 2,575,838 | 11/1951 | Rainard | 28/75 WT |
| 3,180,004 | 4/1965 | Fisher et al. | 28/75 WT |
| 3,529,447 | 9/1970 | Fleissner et al. | 28/75 WT |
| 3,531,237 | 9/1970 | Kalish | 8/17 |
| 3,533,145 | 10/1970 | Fleissner | 28/75 WT |
| 3,634,014 | 1/1972 | Maltenfort | 8/17 |
| 3,788,803 | 1/1974 | Klein et al. | 8/17 |

FOREIGN PATENTS OR APPLICATIONS

| | | | |
|---|---|---|---|
| 606,221 | 10/1960 | Canada | 28/72 FT |
| 2,026,646 | 12/1970 | Germany | 28/75 WT |

*Primary Examiner*—Ronald W. Griffin
*Attorney, Agent, or Firm*—Allison C. Collard

[57] ABSTRACT

The dyeing and finishing of textured textile webs made of synthetic fibers is carried out by immersing the web in a hot dye solution, moving the web and solution in the same direction and at the same speed whereby a constant amount of dye liquid is applied to each unit length of web, the web floating in the liquid in tension-free state, the weight ratio of liquid to web being in the range 10:1 to 50:1, and then subjecting the web to a finishing treatment.

1 Claim, No Drawings

METHOD FOR THE COMBINED PRECLEANING TEXTURE FORMATION AND STABILIZATION AND COLORING OF TEXTILE MATERIALS

CROSS-REFERENCE TO RELATED APPLICATION

This application is a continuation-in-part of application Ser. No. 272,596, filed July 17, 1972, now abandoned.

BACKGROUND OF THE INVENTION

The present invention relates to a novel process for the continuous treatment of a light- to medium-weight textile web with a hot treating liquid. The invention will be described with particular reference to the dyeing of such webs, but should not be regarded as limited to dyeing.

During the finishing treatment of webs of material which consist of texturized synthetic fibers, such as, for example, texturized polyamide fibers, or polyester fibers, it is necessary to remove spinning and weaving oils and other preparations, which have been previously applied thereto, by a precleaning step. After this precleaning operation, the fibers of the material must be dried and then fixed.

There is a difference of opinion among those skilled in the art, however, whether the treatment steps described above should be carried out before or after applying the dye solution to the material. The reason is that, up to the present, the dyeing of undyed texturized materials has been performed on treating machines which provide only for discontinuous operation. Some of these machines employ jet spray application. The conventional jet spray devices have a detrimental influence on the finished material when the dyed material is later subjected to a finishing process lasting from 1 to 4 hours, including texture development and stabilization of the fibers, after the dye has been applied to the material. Modern dyeing operations, performed on continuous dyeing machinery, require only a few minutes exposure in the dye bath, which normally is at very high temperatures.

The art has sought an improved operation by which the swiftly dyed web may be treated with a finishing liquid so that detrimental effects are avoided.

GENERAL DESCRIPTION OF THE INVENTION

In accordance with the present invention, there is provided a method for the treatment of textile webs, and similar lengths of synthetic previously textured fibers, comprising first, a dyeing step, and second, a finishing step.

The process of the invention comprises continuously applying to a moving web, a hot treating liquid, such as a hot dye solution, a substantially constant amount of treating (dye) liquid being applied to each unit length of textile web, which is immersed on the liquid so as to float therein in a substantially tension-free state. The web and liquid travel in the same direction and at the same speed during the treatment, with the web floating in the liquid. The weight ratio of liquid to web is critical and is maintained about 5:1, and preferably between about 10:1 and about 50:1.

The web and dye solution move together until in general substantially all of the dye particles have been exhausted from the bath, so that the residue of dye in the bath is less than about 10% by weight, the dye having been picked up by the textile web.

If a weight ratio of treating liquid to web lower than 15:1 is desired, the tension-free condition of the web can be obtained by placing the material on a moving conveyor belt, which moves at the same speed as the material. The material may be provided with a lead advance portion, and the conveyor belt, if used, should be liquid-permeable. The dye solution may then be sprayed or poured onto the web with provision for recirculating dye solution.

Examples of textile fibers which may be treated in accordance with the invention include polyamide and polyester fibers, or mixtures thereof. Polyamide fibers include various types of nylon, such as nylon 6 and nylon 66. Polyester fibers include those prepared from ethylene glycol and terepthalic acid or its derivatives but are not limited thereto.

The dyestuffs which may be employed in the practice of the invention include those conventionally applied to polyamide or polyester fibers, such as, for example, dispersion dyes for polyester fibers, acid dyes, basic dyes, and dispersion dyes for polyamide fibers.

These dyes are applied in suitable solvent media, such as, for example, glycols, basic aqueous solutions, and water.

The dye bath concentrations are in the range of about 0.1 to about 1.5 grams of dye per liter of dye liquor.

The dye bath temperature is advantageously in the range of about 100° to about 130°C., depending upon the type of dye.

After completion of the dyeing step, the dyed web is subjected to a finishing treatment, using any suitable conventional finishing agent.

During the finishing treatment, the web also preferably floats in tension-free condition in the finishing liquid. Thereafter the web is passed into a suitable drying apparatus.

The apparatus in which this process may be carried out is one of the type described in the literature.

DESCRIPTION OF THE PREFERRED EMBODIMENTS

The following examples illustrate the practice of the process of the invention, but are not to be regarded as limiting:

EXAMPLE 1

A heavy textile web made of a mixture of texturized polyester fibers is heated to a temperature of about 130°C. and then introduced into a dye bath separated from the path of the textile, and likewise heated to 130°C, containing a dispersion dye, the dye carrier liquid of which is a solvent having a boiling point above 130°C. and which bath is positioned in a level channel of the type described in U.S. application Ser. No. 461,190 filed Apr. 12, 1974. The textile web floats in a tension-free state in the channel in the liquid which therein is about 3 cm. deep, moving in the same direction and at the same speed. The ratio of weight of treating liquid to web is about 15:1. During the passage of the textile web and the dye bath through the channel dye particles migrate from the dye liquid into the web. The textile web and the treating liquid move together through the channel until in general all the particles of dye have been exhausted from the liquid so that the residue in the latter is less than 10%, and the dye has been picked up by the web.

During the passage of the dye onto the web there takes place, due to the action of the boiling carrier liquid in combination with an intensive fulling movement, a purification of the textile web from finishing and spinning oils while at the same time, a development of structure and swelling takes place. Thereafter the web is removed from the dye bath and, without tension, is passed to a drying apparatus.

EXAMPLE 2

A light textile web made from polyamide fibers is heated to a temperature of about 100°c. and then introduced into an aqueous dye bath containing an acid dye and a pH regulator (sodium monophosphate), separated from the textile web path, which is likewise heated to about 100°C. The textile web and the treating liquid then pass together through a substantially level treating apparatus of the kind described in U.S. Pat. No. 3,849,068. The textile web thereby floats in many convolutions in tension-free state in the liquid, wherein the ratio of weight of treating liquid to web is about 15:1, and thus, together with the treating liquid, is passed through the treating apparatus. In the course of this passage, the acid dye migrates to the textile web, to an extent that there remains in the dye carrier liquid a residue of only about 10%, and at the same time spinning and web treating assistants pass from the web into the treating liquid. During the passage the textile web is subjected to mechanical manipulative impulses, as described in U.S. Pat. No. 3,849,068. Finally, the textile web is withdrawn from the treating liquid and subjected to a tension-free drying and fixation step in accordance with known procedures.

What is claimed is:

1. Process for the dyeing and finishing of webs of textured synthetic fibers, comprising the steps of:

a. heating said textile web to a temperature between about 100°C and about 130°C;

b. introducing said heated web into a separately heated dye bath maintained at a temperature between about 100°C and 130°C;

c. moving the web and dye solution in the same direction and at substantially the same speed whereby a substantially constant amount of dye liquid is applied to each unit length of web, the web floating in the liquid, the weight ratio of liquid to web being in the range of about 10:1 to about 50:1, until substantially all the dye particles have been absorbed from the bath by the web, the web being in a substantially tension-free state and being subjected, during the passage of dye onto the web, to intensive movement for removal of any spinning and treating assistants present in the web while simultaneously being subjected to structure and swelling development.

* * * * *